United States Patent [19]

Logsdon

[11] 4,010,578

[45] Mar. 8, 1977

[54] ROOF FLASHING STRUCTURE

[76] Inventor: Duane D. Logsdon, 1708 Calavera Place, Fullerton, Calif. 92631

[22] Filed: Nov. 11, 1974

[21] Appl. No.: 522,788

[52] U.S. Cl. ..... 52/58; 52/199; 285/44

[51] Int. Cl.[2] ..... E04D 1/36

[58] Field of Search ..... 52/58, 199; 285/42, 285/43, 44

[56] References Cited

UNITED STATES PATENTS

| | | | |
|---|---|---|---|
| 3,098,663 | 7/1963 | Dibley | 285/43 |
| 3,313,559 | 4/1967 | Kifer | 285/43 |
| 3,731,952 | 5/1973 | Elwart | 285/44 X |
| 3,797,181 | 3/1974 | Nievelt | 52/199 X |

OTHER PUBLICATIONS

The Condensed Chemical Dictionary, 8th Edition, Gessner G. Hawley, 1971, pp. 2, 14, 528.

*Primary Examiner*—Ernest R. Purser
*Assistant Examiner*—Carl D. Friedman

[57] ABSTRACT

A roof flashing structure for use in forming a seal around a pipe on either flat roofs or roofs pitched at various common angles can be constructed utilizing a generally flat, imperforate plate having a centrally located opening. Such a plate carries an upstanding, imperforate housing extending outwardly from one side of the plate, this housing terminating in an open end located remote from the plate of larger dimension than the pipe. An annular retainer is carried by this end of the housing; a resilient elastomeric sealing member is carried by the retainer. This sealing member engages the exterior of the pipe in such a manner as to form a seal against the pipe, and in such a manner as to permit the plate to be adjusted relative to the pipe so as to fit against either a flat roof or a roof at any commonly used pitch. The plate, the housing and the retainer are preferably formed integrally with one another out of a sheet of ABS material laminated to a surface covering of a degradation resistant acrylic composition.

2 Claims, 3 Drawing Figures

ROOF FLASHING STRUCTURE

BACKGROUND OF THE INVENTION

The invention set forth in this specification pertains to new and improved roof flashing structures for use on a roof so as to form a seal around a pipe extending through the roof.

The term "flashing" is commonly utilized in the building trade to designate pieces of sheet metal or the like used to cover and protect various types of joints. Various different specific flashing structures are commonly utilized in covering and protecting different types of joints. Thus, for example, it has been commonplace to utilize flashing structures for covering and protecting joints between a roof and a vent pipe or the like which have been constructed so as to utilize a flat plate or sheet of material carrying an upstanding flange adapted to fit around the exterior of such a pipe. Normally the flange in such a structure is sealed to such a pipe by a calking type composition. At times such sealing compositions are referred to as mastics.

Specialized roof flashing structures as indicated in the preceding paragraph are commonly recognized to have certain limitations. Normally such structures can only be utilized with a roof located at a specific angle to a pipe extending through the roof. This is disadvantageous because it necessitates the maintenance of an inventory of different flashing structures for use with different roofs which are flat or are sloped at various different angles. Roof flashing structures as indicated are also considered disadvantageous because of the use of the compositions which are employed to form a seal between them and a pipe. In general such compositions tend to be somewhat messy, difficult and time consuming to apply. Further, such compositions will frequently tend to crack and/or deteriorate after prolonged use. This, of course, will result in either leakage or the possibility of leakage.

SUMMARY OF THE INVENTION

It is believed that it will be apparent from the preceding that there is a need for improvement in the field of roof flashing structures and more specifically in connection with roof flashing structures which are utilized around pipes such as vent pipes. A broad objective of the present invention is to fulfill this need. The invention is also intended to provide roof flashing structures as indicated which can be constructed at a comparatively nominal cost, which can be easily and conveniently installed and which are capable of giving prolonged, reliable service. While all of these items are important it is considered that the cost of installing roof flashing structures of the present invention makes them particularly desirable as compared to prior structures.

In accordance with this invention these various objectives are achieved by providing a roof flashing structure for use on a roof so as to form a seal around a pipe extending through the roof which comprises: a generally flat, imperforate plate adapted to overlie and fit against a roof, this plate having a centrally located opening of larger dimension than the pipe formed therein, an upstanding, imperforate housing located on one side of the plate so as to extend outwardly from this side of the plate, this housing extending around the opening and having an open end of larger dimension than the pipe located remote from the plate, an annular retainer means for holding a sealing member located on this end of the housing, this retainer means being capable of fitting around the exterior of the pipe, and a resilient, elastomeric sealing member held by the retaining means and extending from the retainer means towards the interior of the retainer means, this sealing member being capable of resiliently engaging the exterior of the pipe when the pipe extends through the opening, the housing and the retainer means so as to form a seal against the exterior of the pipe.

BRIEF DESCRIPTION OF THE DRAWING

The invention is best more fully described with reference to the accompanying drawing in which.

Figure 1:
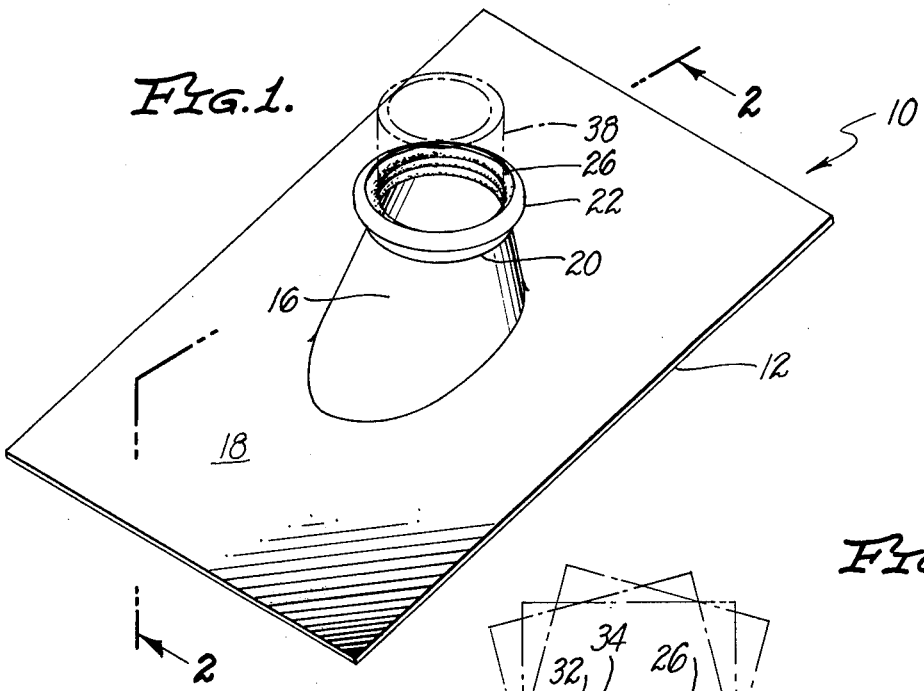
FIG. 1 is an isometric view of a presently preferred embodiment of a roof flashing structure in accordance with the invention in which a vent pipe is shown in phantom.

The roof flashing structure illustrated in the drawing embodies the concepts of this invention set forth and defined in the appended claims. These concepts may be easily utilized in other somewhat differently appearing roof flashing structures through the use or exercise of routine engineering skill.

DETAILED DESCRIPTION

The roof flashing structure 10 illustrated in the accompanying drawing includes a generally flat plate 12 which is adapted to overlie and fit flat against a roof (not shown). This plate 12 has a centrally located opening 14. An upstanding housing 16 is attached to the plate 12 around the periphery of the opening 16 so as to extend upwardly from an upper surface or side 18 of the plate 12. This housing 16 is of a generally tapered shape and has its largest dimension adjacent to the plate 12; it terminates in an open end 20 which is located remote from the plate 12. This end 20 is attached to and carries a retainer ring 22 located so as to be positioned on the end 20 generally away from the plate 12.

The interior of this ring 22 is formed so as to include an inwardly directed groove 24 which extends completely around the interior of the ring 22. This groove 24 has a curved, circular cross-sectional shape as shown. The groove 24 is used to hold an annular or ring-like elastomeric, resilient sealing member 26 having an outer surface 28 which conforms to the interior shape of the groove 24. The interior 30 of the sealing member 26 is provided with a plurality of inwardly projecting sealing flanges 32, 34 and 36, each of which is of a partially circular cross-sectional configuration. These flanges 32, 34 and 36 successively decrease in internal dimension or diameter in such a manner that the flange 36 located closest adjacent to the plate 12 is the flange 36 located closest adjacent to the plate 12 is the largest of these flanges.

When the structure 10 is to be utilized it is assembled with the sealing member 26 in the retainer 22 as shown. The structure 10 can then be brought down upon a vent pipe 38 as is shown in phantom in FIG. 1. The successive changes in internal dimensions of the sealing flanges 36, 34 and 32 facilitate the structure 10 being pulled to an operative position in this manner. These flanges 32, 34 and 36 are dimensioned so that all of these flanges will resiliently engage the vent pipe 38 as the structure 10 is assembled in this manner so as to each form a seal against the exterior of the pipe 38.

Figure 2:
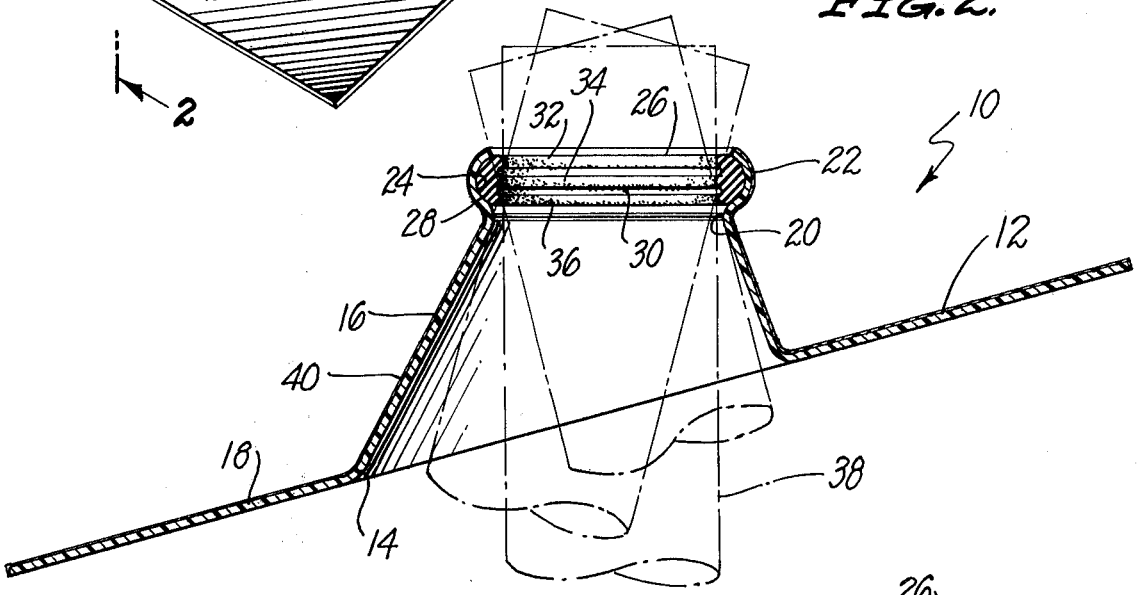
FIG. 2 is a cross-sectional view taken at line 2—2 of FIG. 1 in which the vent pipe illustrated in phantom in FIG. 1 is illustrated as extending vertically and in which alternate manners in which the vent pipe can extend are indicated in phantom at an angle to the vertical.
Figure 3:
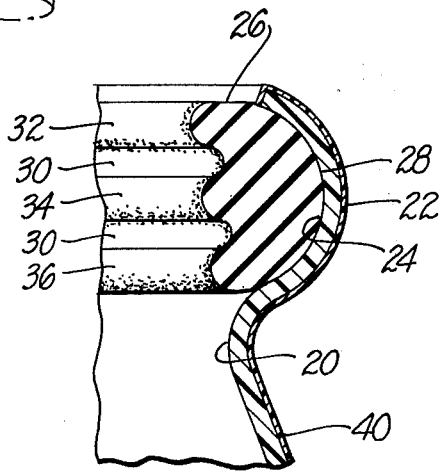
FIG. 3 is an enlarged, fragmentary cross-sectional view corresponding to a part of FIG. 2.

When the structure 10 is moved in this manner it will normally be moved along the pipe 38 until such time as the plate 12 hits against a roof. The structure 10 can then be twisted on the pipe 38 so that the pipe 38 extends through it in any of the manners shown in phantom in FIG. 2 so as to permit the plate 12 to be located against either a flat roof or a roof constructed at any common angle to the horizontal. Thus, the plate 12 can be located at a right angle to the pipe 38 or at a plurality of other angles relative to this pipe 38.

In order to achieve this mode of operation the opening 14, the end 20 and the retainer ring 22 must all be constructed so as to be larger than the vent pipe 38 with which the structure 10 is to be used. Further, the housing 16 must be tapered in the manner indicated so as to accommodate the pipe 38 being located relative to the structure 10 in any of the manners indicated. The shape of the groove 24 and of the sealing member 26 are both considered to facilitate seals being formed against the exterior of the pipe 38 in all positions of this pipe.

Although the structure 10 can be constructed from a number of different materials in a number of different ways it is presently preferred to construct the structure 10 so that all parts of its except the sealing member 26 are integral with one another and are imperforate. When the structure 10 is constructed in this manner and is used as described only a very limited amount of the sealing member 26 is exposed to ambient conditions such as might cause degradation of the material in the sealing member 26. This is considered important in enabling the structure 10 to be utilized over a prolonged period. If for any reason such degradation shall commence and shall affect the uppermost sealing flange 32 the other sealing flanges 34 and 36 will still remain operative for their intended purpose.

It is preferred to manufacture the entire structure 10 except for the sealing member 26 of a polymer material which will not rust or corrode in use. It is considered that preferred results can be achieved when such a body is formed of a common ABS polymer composition covered with a thin acrylic layer 40 which is laminated in place by thermal means. Such as ABS polymer body is, of course, though and rigid since ABS material itself is relatively tough and rigid. Such an acrylic layer 40 is much more resistant to normal ambient conditions than ABS material and, hence, enables the structure 10 to be satisfactorily employed over a prolonged period.

Unquestionably the latter is quite important as far as the utility of the present invention is concerned. It is, however, considered secondary to the ease of installing a structure 10 in an operative location. It is considered that considerable labor savings can be achieved in installing the structure 10. This structure 10 is of such a nature that it does not require the use of caulking or mastic type compositions. Hence, it avoids the steps of using such compositions in installing the roof flashing structure. This structure 10 also avoids cracking and other related problems frequently encountered with caulking or masking compositions.

The utility of the structure 10 can be improved by making the layer 40 at the upper surface 18 of a textured or irregular surface configuration. Such a roughened surface configuration is considered desirable because hot tar and other compositions such as are commonly employed in roofing will adhere to such a roughened surface more easily than to a smooth surface.

I claim:

1. A roof flashing structure for use on a roof so as to form a seal around a pipe extending through the roof which comprises:

a generally flat, imperforate plate adapted to overlie and fit against a roof, said plate having a centrally located opening of longer dimension than said pipe formed therein, an upstanding, imperforate, tapered housing located on one side of said plate so as to extend outwardly from said side of said plate, said housing extending around said opening, said housing having an open end of larger dimension than said pipe located remote from said plate, said housing being of its largest dimension adjacent to said plate, an annular retainer means for holding a sealing member located on said open end of said housing, said retainer means being capable of fitting around the exterior of said pipe, said retainer means comprising a ring, the interior of said ring having an inwardly facing groove formed therein, said groove having a curved, circular cross-sectional shape and extending completely around the interior of said ring, and said plate, said housing and said retainer means being integral with one another and being formed of a rigid material, a resilient, elastomeric sealing member held by said retainer means and extending from said retainer means towards the interior of said retainer means, said sealing member having an outer surface conforming to the interior shape of said groove and including a plurality of separate sealing flanges extending therefrom toward the interior of said sealing member, each of said sealing flanges being capable of separately engaging said pipe, said retainer means and said housing being of sufficient dimension so as to permit said plate to be positioned at a right angle to said pipe and at a plurality of other angles to said pipe, said sealing member projecting inwardly from said retainer means a sufficient distance and being sufficiently flexible to form a seal with said pipe in all positions of said plate relative to said pipe.

2. A roof flashing structure as claimed in claim 1 wherein:

said flanges have successively decreasing internal diameter, the one of said flanges closest to said plate having the largest internal diameter of any of said flanges, the one of said flanges furthest from said plate having the smallest internal diameter of any of said flanges, each of said flanges having a curved extremity extending toward the interior of said sealing member.

* * * * *